US010096221B2

(12) United States Patent
Von Ehrenkrook

(10) Patent No.: US 10,096,221 B2
(45) Date of Patent: Oct. 9, 2018

(54) PERSONAL PROTECTION DEVICE

(71) Applicant: Andrew J. Von Ehrenkrook, Madison, VA (US)

(72) Inventor: Andrew J. Von Ehrenkrook, Madison, VA (US)

( * ) Notice: Subject to any disclaimer, the term of this patent is extended or adjusted under 35 U.S.C. 154(b) by 0 days.

(21) Appl. No.: 15/624,574

(22) Filed: Jun. 15, 2017

(65) Prior Publication Data

US 2017/0365145 A1 Dec. 21, 2017

Related U.S. Application Data

(60) Provisional application No. 62/351,341, filed on Jun. 17, 2016.

(51) Int. Cl.
*G08B 15/00* (2006.01)

(52) U.S. Cl.
CPC ..... *G08B 15/004* (2013.01)

(58) Field of Classification Search
CPC ..... G08B 15/00; G08B 15/004
USPC ... 116/67 R, 70, 137 A, 137 R, 139, DIG. 7, 116/DIG. 44; 222/39
See application file for complete search history.

(56) References Cited

U.S. PATENT DOCUMENTS 2,876,935 A * 3/1959 Lindberg ..... F41H 9/10 116/112
3,670,690 A * 6/1972 Swanson ..... G10K 9/04 116/112
3,765,334 A * 10/1973 Rentz et al. ..... C06B 23/009 102/202.1
4,130,082 A * 12/1978 Bouchard et al. ..... F21K 5/02 116/5
4,247,844 A * 1/1981 Zapolski et al. ..... G08B 7/06 116/70
4,759,309 A * 7/1988 Zediker ..... B65D 83/75 116/112
5,517,180 A * 5/1996 Masi et al. ..... F41H 9/10 222/613
5,644,297 A * 7/1997 Masi et al. ..... F41H 9/10 222/613
5,949,338 A * 9/1999 Masi et al. ..... F41H 9/10 116/2
8,245,878 B2 * 8/2012 Smith et al. ..... F41H 9/10 222/3
8,578,874 B2 * 11/2013 Withers ..... B65D 83/753 116/137 A
9,691,244 B2 * 6/2017 Weng ..... G08B 15/02
2004/0046669 A1 * 3/2004 Chiapperini ..... G08B 15/004 340/574
2006/0117981 A1 * 6/2006 Williams ..... G08B 15/004 102/335

(Continued)

FOREIGN PATENT DOCUMENTS

CA 2401760 A1 * 3/2004 ..... G08B 15/004
JP 2005141707 A * 6/2005 ..... G08B 15/00

*Primary Examiner* — R. A. Smith
(74) *Attorney, Agent, or Firm* — The Iwashko Law Firm, PLLC

(57) ABSTRACT

A personal protection device, including a central casing including a battery, a toggle button connected to the battery, and a sealed housing including a coil switchably connected to the battery and a liquid, such that pressing the toggle button connects the battery to the coil to heat the liquid to convert the liquid to a gas until an audible shock wave is generated.

10 Claims, 10 Drawing Sheets

(56) References Cited

U.S. PATENT DOCUMENTS

2011/0140845 A1* 6/2011 Sanders ..... G08B 15/004
340/6.1

* cited by examiner

PERSONAL PROTECTION DEVICE

CROSS-REFERENCE TO RELATED APPLICATIONS

This application claims priority under 35 USC § 120 from U.S. Provisional Application No. 62/351341, filed on Jun. 17, 2016, in the United Stated Patent and Trademark Office, the disclosure of which is incorporated herein in its entirety by reference.

BACKGROUND OF THE INVENTION

1. Field of the Invention

The present general inventive concept relates to a personal protection device.

2. Description of the Related Art

Personal distraction devices (i.e., personal protection devices) are used by military and law, enforcement units throughout the world. Typically, personal distraction devices produce a blinding flash of light and/or smoke, coupled with overpressure and loud noise (170-180 dB) to distract a hostile person. This distraction buys enough time for action to take place which otherwise might have resulted in injury or operational compromise.

Recently, personal distraction devices have been marketed to the public. However, because of ATF regulations, non-military/non-law enforcement personnel cannot purchase, store, transport or use any device which contains more than 50 milligrams of pyrotechnic flash powder. The M84 (U.S. Pat. No. 8,161,883 B1) is the gold standard for personal distraction devices. The M84 contains between 8 and 10 grams of flash powder (160 to 200 times above the legal limit). The M84 use is therefore relegated to military and law enforcement use. Despite the regulations, companies continue to market "solutions" to the public.

The following is a non-exhaustive list of the personal protection devices currently available, and their capabilities and limitations:

1. Whistle—Pros: Ease of use, low maintenance, small form factor, inexpensive Cons: Best whistles produce noise below 130 dB human pain threshold, cannot deploy away from user you become the target when you employ a whistle. 2. Snap-cracks—Pros: Ease of use, low maintenance, small form factor, inexpensive Cons: Contains highly sensitive silver fulminate (primary explosive), not deployable on turf or other non-rigid surfaces, not stable enough for daily carry (will detonate in your pocket). 3. Spherical flashlights—Pros: Rugged, re-usable; Cons: Large form factor, expensive, random/non-reproducible effects, environment should be dark. 4. Sirens—Pros: surpasses 130 dB human pain threshold, rugged, reusable, can be inexpensive; Cons: typically no delay function, form factor often not suitable for daily carry. 5. Strobe lights—Pros: rugged, reusable; Cons: directional effects, environment needs to be dark. 6. Pepper spray—Pros: physiologically effective, form factor suitable for daily carry, easy to use: Cons: Close range deployment requires face to face positioning, illegal in some jurisdictions. 7. Smoke grenade—Pros: visual obscuration, ease of use; Cons: requires secondary initiation device (effectively two handed operation), takes long time to produce effects (full volume of obscuration), form factor not suitable for daily carry. 8, CO2 grenade—Pros: many surpass 130 dB human pain threshold; Cons: one time use, form factor not suitable for daily carry. 9. Taser—Pros: physiologically effective, form factor suitable for daily carrying, Cons: expensive, not legal in some jurisdictions, close range deployment.

As such, there is a need for a personal protection device that capitalizes on as many positive aspects of the presently-available personal protection devices as possible, while avoiding the negative aspects.

SUMMARY

The present general inventive concept provides a personal protection device to distract an aggressor when a user is in danger.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a personal protection device, including a central casing including a battery, a toggle button connected to the battery, and a sealed housing including a coil switchably connected to the battery and a liquid, such that pressing the toggle button connects the battery to the coil to heat the liquid to convert the liquid to a gas until an audible shock wave is generated.

The personal protection device may further include a timer integrated circuit connected to the battery to provide a delay of a predetermined length of time between a first moment when the toggle button is depressed and a second moment when the audible shock wave is generated.

The personal protection device may further include a bottom cap to house the sealed housing and at least a portion of the central casing, and a removable top cap to house the toggle button and at least another portion of the central casing.

The bottom cap may include at least one aperture to allow gas to escape therefrom.

The bottom cap may include a casing space to house the sealed housing therein.

The central casing may further include a female Universal Serial Bus port to allow the battery to be charged without removing the battery from the central casing.

The foregoing and/or other features and utilities of the present general inventive concept may be achieved by providing a personal protection device, including a central casing including a battery, a toggle button connected to the battery, a removable top cap to enclose the toggle button, the battery, and at least a portion of the central casing therewithin, a sealed housing including a combustible or vaporable composition therewithin, such that the combustible or vaporable composition deflagrates after the toggle button is pressed, and a bottom cap to enclose the sealed housing and at least a portion of the central casing therewithin.

The sealed housing may further include a coil switchably connected to the battery and the combustible or vaporable composition, such that the coil produces heat in response to the pressing of the toggle button.

The pressing of the toggle button may electrically connect the battery to the coil to heat the liquid to convert the liquid to a gas until an audible shock wave is generated.

The personal protection device may further include a timing circuit to provide a delay between the pressing of the toggle button and the heating of the coil.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail, it should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent" etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1C:
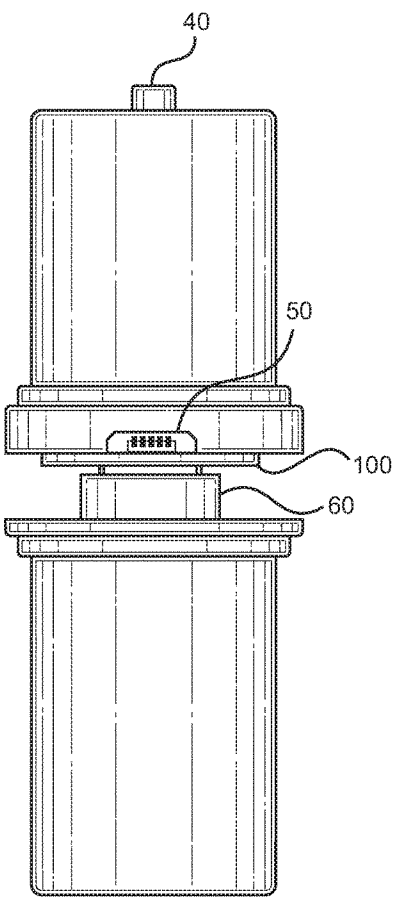
FIG. 1C illustrates a diagram of the central casing of the personal protection device being pulled apart, according to an exemplary embodiment of the present general inventive concept.
Figure 1B:
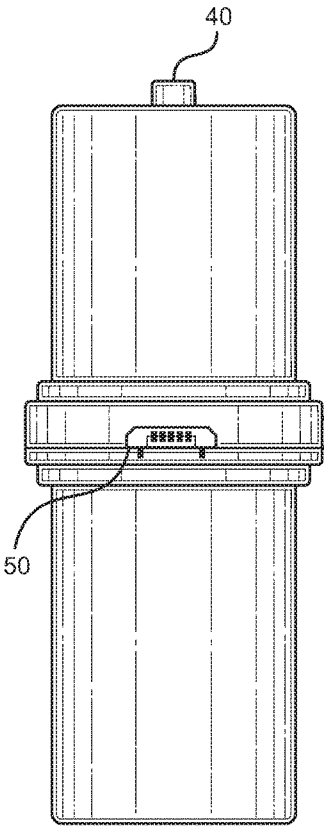
FIG. 1B illustrates a diagram of a central casing of the personal protection device, according to an exemplary embodiment of the present general inventive concept.
Figure 1A:
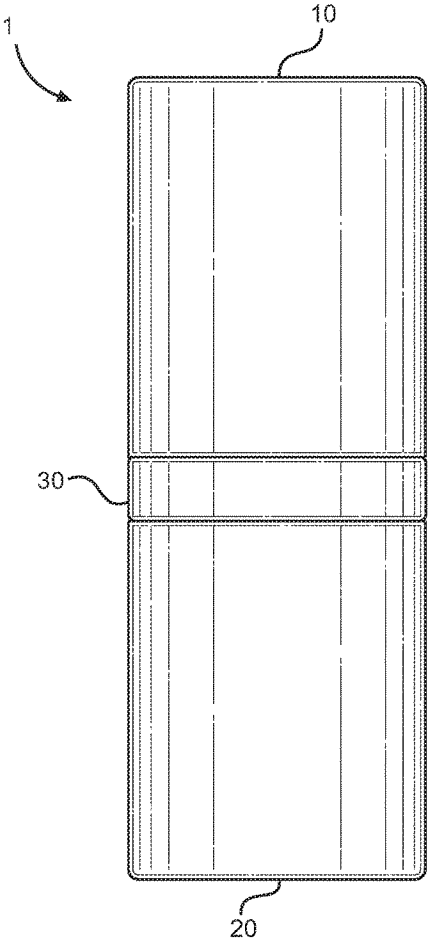
FIG. 1A illustrates a diagram of a personal protection device, according to an exemplary embodiment of the present general inventive concept.

FIG. 1A illustrates a diagram of a personal protection device 1, according to an exemplary embodiment of the present general inventive concept.

Referring to FIG. 1A, the person& protection device 1 (a.k.a., a personal distraction device) may include a top cap 10, a bottom cap 20, and a central casing 30. The top cap 10 may be pulled apart from the bottom cap 20.

FIG. 1B illustrates a diagram of the central casing 30 of the personal protection device 1, according to an exemplary embodiment of the present general inventive concept.

Referring to FIG. 1A, when the top cap 10 is pulled apart from the bottom cap 20, a pressable toggle button 40 attached to a top surface of the central casing 30 may be exposed.

The central casing 30 may also include a female universal serial bus (USB) port 50, to allow for charging of a battery 101 (not illustrated).

FIG. 1C illustrates a diagram of the central casing 30 of the personal protection device 1 being pulled apart, according to an exemplary embodiment of the present general inventive concept.

Referring to FIG. 1C, as the central casing 30 is pulled apart, a sealed housing 60 and a printed circuit board (PCB) 100 may be exposed.

Figure 2B:
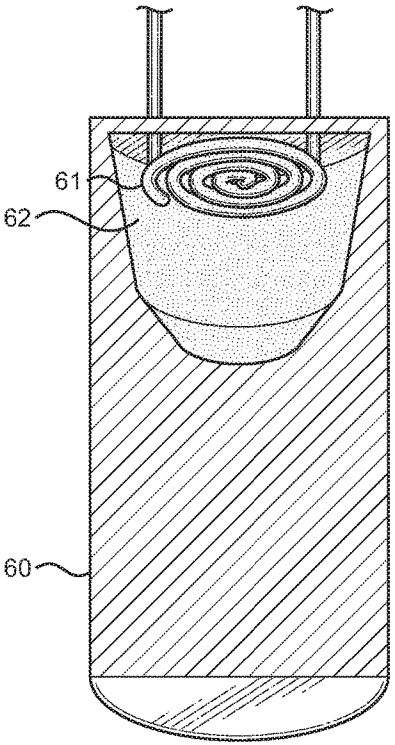
FIG. 2B illustrates a zoomed-in view of a sealed housing, according to an exemplary embodiment of the present general inventive concept.
Figure 2A:
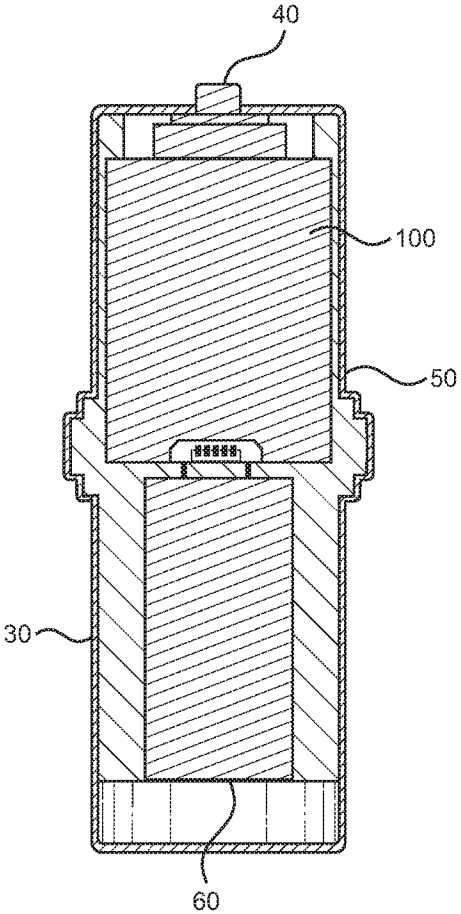
FIG. 2A illustrates a cross section of the casing of the personal protection device, according to an exemplary embodiment of the present general inventive concept.

FIG. 2A illustrates a cross section of the casing 30 of the personal protection device 1, according to an exemplary embodiment of the present general inventive concept.

Referring to FIG. 2A, it is possible to view a configuration of the toggle button 40, the female USB port 50, the sealed housing 60, and the PCB 100.

FIG. 2B illustrates a zoomed-in view of a sealed housing 60, according to an exemplary embodiment of the present general inventive concept.

Referring to FIG. 2B, the sealed housing 60 may include a coil 61 (a.k.a., filament 61) and a liquid 62.

Referring to FIGS. 1 through 2B, a user may remove a tamper seal sticker (not illustrated) to allow the user to remove the top cap 10. After the top cap 10 is removed, the toggle button 40 is visible and accessible to the user. When the user depresses the toggle button 40, the battery 101 allows a current to flow through the PCB 100. The current flows through a first portion of the PCB 100. After a predetermined time delay based on arrangements and values of components within the PCB 100, the current flows thorough a second portion of the PCB 100. The time delay may be predetermined based on a preference of the user.

After the predetermined time delay, the current eventually flows to the coil 61, which is disposed within the sealed housing 60. The liquid 62 may also be disposed within the sealed housing 60. When the current flows to the coil 61, a temperature of the coil 61 increases. The liquid 62 may be a low boiling point liquid, and the raised temperature of the coil 61 may cause the liquid 62 to boil. The liquid 62 may include Methanol, ethanol, isopropyl alcohol, acetone, and a starting fluid a mixture of hexane and diethyl ether), but is not limited thereto. As the liquid 62 boils, vapor is produced within the sealed housing 60. As amounts of temperature (i.e., heat) and vapor increase within the sealed housing 60, a pressure within the sealed housing 60 increases. The increased pressure within the sealed housing 60 ultimately ruptures the sealed housing 60, allowing the vapor to vent/escape at a rapid rate. This venting displaces atmospheric gases, at a rate faster than 340 meters per second, for example, thereby generating an audible shock-wave.

The housing 60 may be formed to ensure that no potential shrapnel exits the personal protection device 1.

It is preferable for the user to throw the personal protection device 1 after the toggle button 40 is depressed, so that the personal protection device 1 is far from the user when the audible shock-wave sounds. The sound of the audible shock-wave is intended to distract a potential enemy (e.g., assailant, robber, attacker, etc.), thereby allowing the user to either dispatch the enemy, or flee the area while the enemy is temporarily distracted by the sound.

The female USB port 50 may be optional, and may be connected to the battery 101 to allow the battery 101 to be charged and/or recharged. The battery 101 requires charging to allow a proper amount of current to be supplied to the PCB 100. The battery may retain its charge for a long time, based on a type of the battery 101. As such, a user may only require charging of the personal protection device 1 every 3, 6, 0, or even 12 months. The female USB port 50 may be a micro USB port, a mini USB port, a standard USB port, or a USB Type-C port, but is not limited thereto.

Figure 3A:
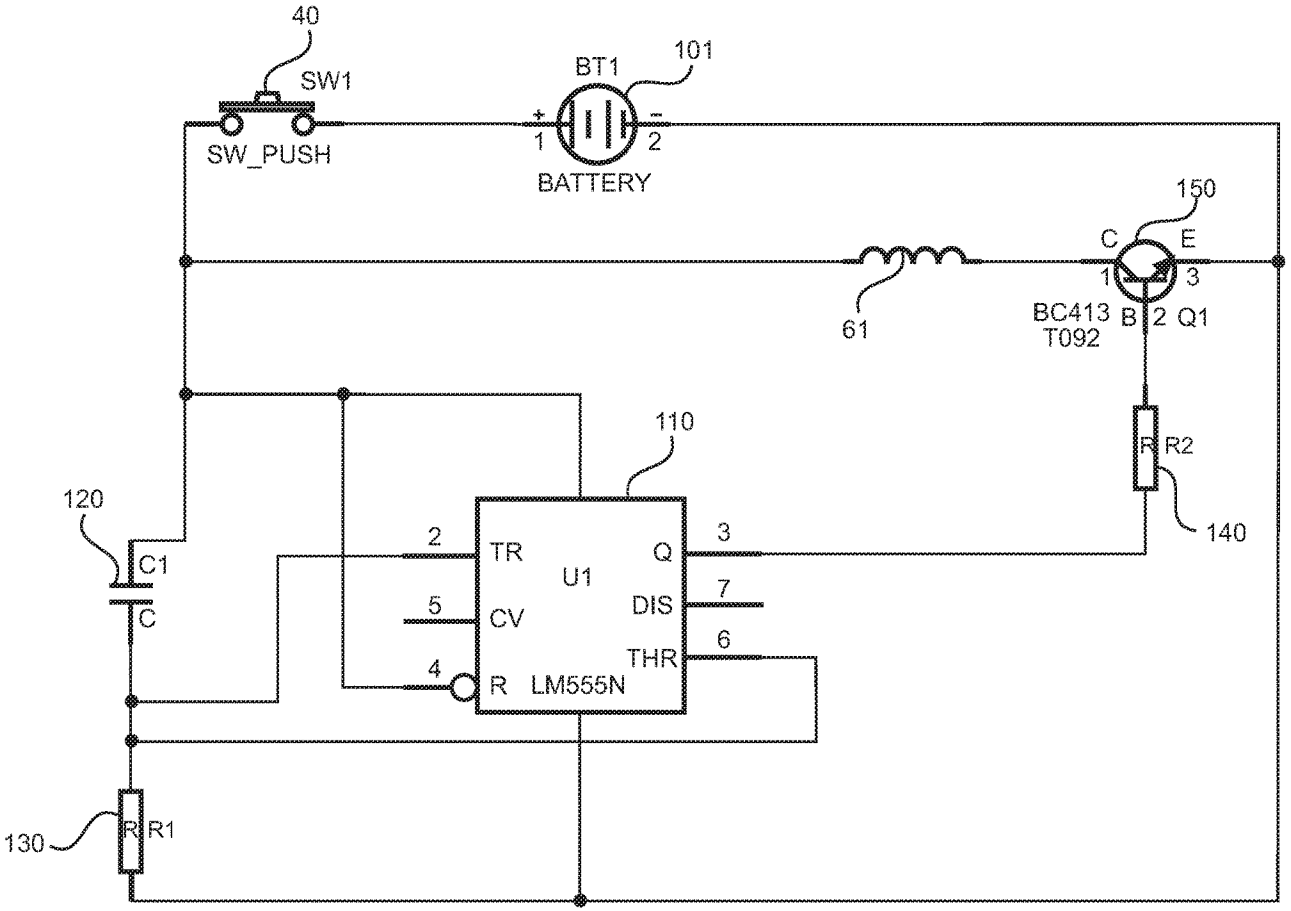
FIG. 3A illustrates a circuit schematic of a printed circuit board connected to a coil, according to an exemplary embodiment of the present general inventive concept.

FIG. 3A illustrates a circuit schematic of a printed circuit board 100 connected to a coil 61 and a toggle button 40, according to an exemplary embodiment of the present general inventive concept.

Figure 3B:
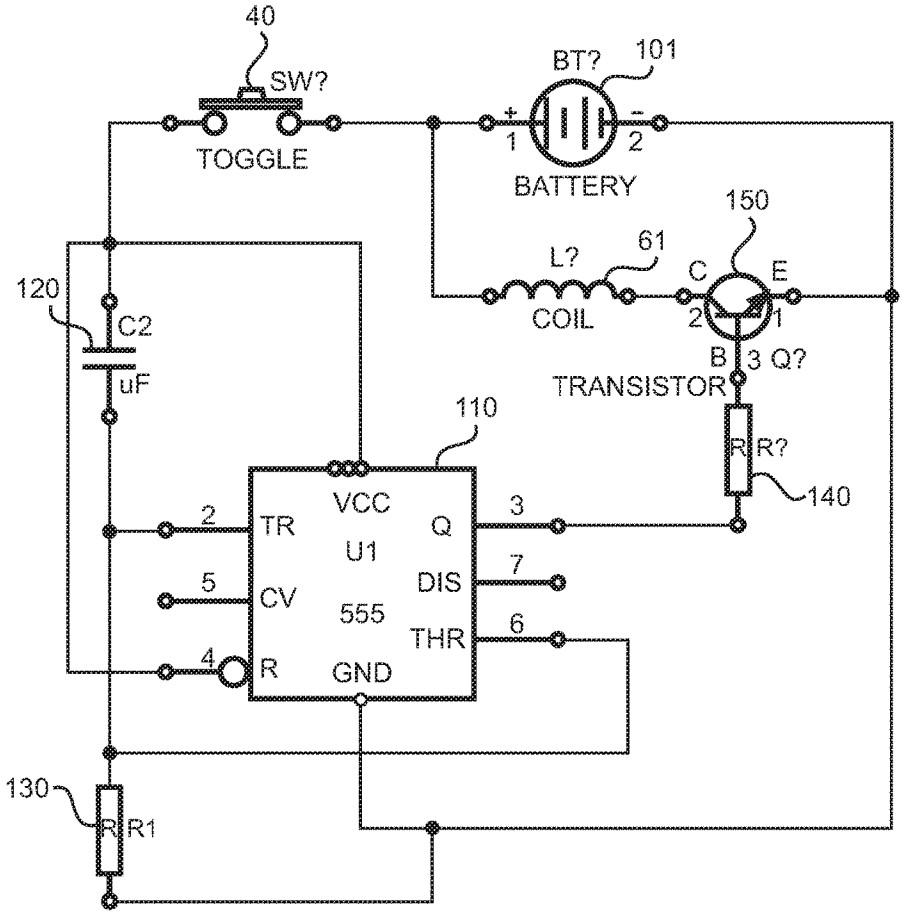
FIG. 3B illustrates a circuit schematic of the printed circuit board connected to the coil and the toggle button, having a layout different from the circuit schematic of FIG. 3A, according to an exemplary embodiment of the present general inventive concept.

FIG. 3B illustrates a circuit schematic of a printed circuit board 100 connected to a coil 61 and a toggle button 40, having a layout different from the circuit schematic of FIG. 3A, according to an exemplary embodiment of the present general inventive concept. Although FIGS. 3A and 3B differ slightly, both circuits produce a similar result when the toggle button 40 is depressed.

Referring to FIGS. 3A and 3B, the printed circuit board 100 may include a battery 101, a timer integrated circuit 110, a capacitor 110, a resistor 130, a resistor 140, and a transistor 150.

Referring to FIGS. 3A and 3B when a user depresses the toggle button 40, a circuit connection between the battery 101 and the timer integrated circuit 110 is closed, thereby allowing current to flow from the battery 101 to the timer integrated circuit 110. The timer integrated circuit 110 may be a 555 timer integrated circuit, but is not limited thereto.

The depression of the toggle button 40 also closes a circuit between the battery 101 and the capacitor 120, thereby allowing current to flow from the battery 101 to the capacitor 120.

The capacitor 120 may be connected to the resistor 130. Corresponding values of the capacitor 120 and the resistor 130 may establish an amount of time it takes for a pin 2 of the timer integrated circuit 110 to reach ⅔ total source voltage. When the pin 2 of the timer integrated circuit 110 reaches ⅔ total source voltage, current is passed to a pin 3 of the timer integrated circuit 110. The current is then passed from the pin 3 of the timer integrated circuit 110 to the resistor 140 and then to the transistor 150, which acts as an electrical switch. More specifically, the transistor 150 allows current to flow to the coil 61. It is important to note that until the current enters the transistor 150, a circuit between the coil 61 and the source voltage is open and no current flows through the coil 61.

Figure 4:
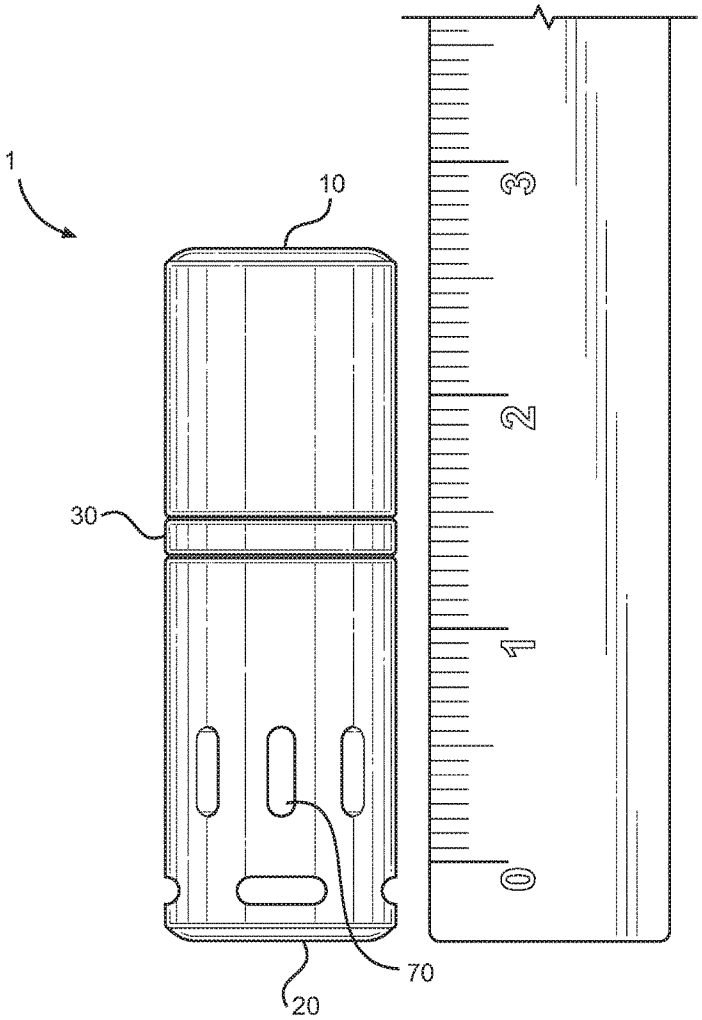
FIG. 4 illustrates a personal protection device, according to another exemplary embodiment of the present general inventive concept.

FIG. 4 illustrates a personal protection device 1 according to another exemplary embodiment of the present general inventive concept.

Referring to FIG. 4, the personal protection device 1 (a.k.a., a personal distraction device) may include a top cap 10, a bottom cap 20, a central casing 30, and at least one aperture 70. The top cap 10 may be pulled apart from the bottom cap 20. The at least one aperture 70 may be included in the bottom cap 20 to allow any potential gases to escape therefrom to prevent the bottom cap 20 from exploding due to pressure within the bottom cap 20.

Figure 5:
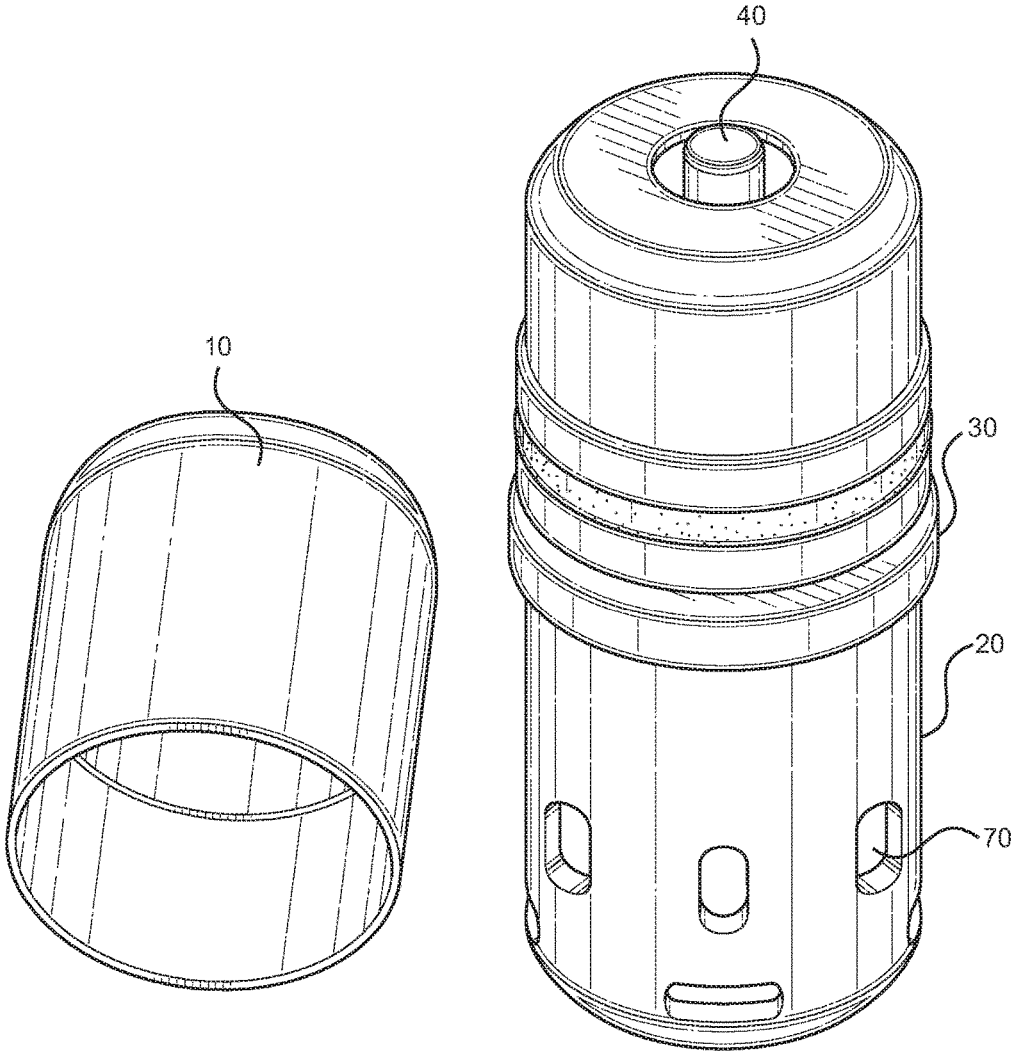
FIG. 5 illustrates the personal protection device with a top cap removed, according to another exemplary embodiment of the present general inventive concept.

FIG. 5 illustrates the personal protection device 1 with a top cap 10 removed, according to another exemplary embodiment of the present general inventive concept.

Referring to FIG. 5, when the top cap 10 is pulled apart from the bottom cap 20, a pressable toggle button 40 attached to a top surface of the central casing 30 may be exposed.

Figure 6B:
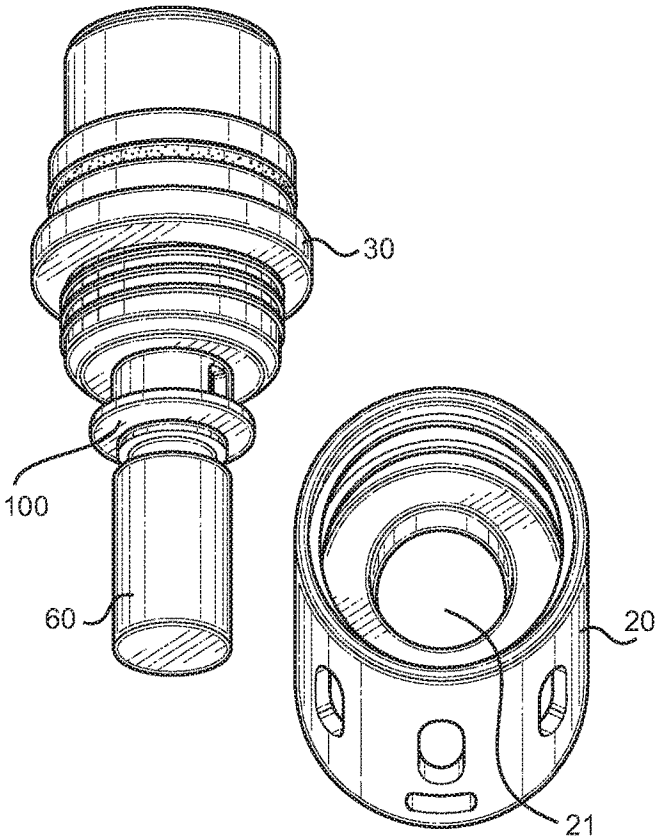
FIG. 6B illustrates another view of the personal protection device with the central casing removed, according to another exemplary embodiment of the present general inventive concept.
Figure 6A:
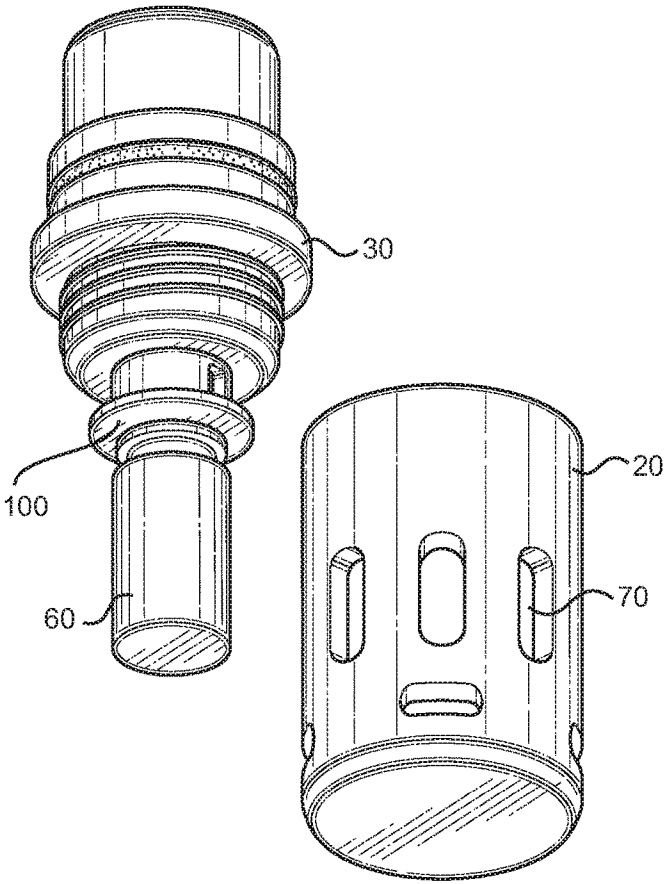
FIG. 6A illustrates the personal protection device with a central casing removed, according to another exemplary embodiment of the present general inventive concept.

FIG. 6A illustrates the personal protection device 1 with a central casing 30 removed, according to another exemplary embodiment of the present general inventive concept.

Referring to FIG. 6A, when the central casing 30 is removed from the bottom cap 20, a sealed housing 60 and a printed circuit board (PCB) 100 may be exposed.

FIG. 6B illustrates another view of the personal protection device 1 with the central casing 30 removed, according to another exemplary embodiment of the present general inventive concept.

Referring to FIG. 6B, a casing space 21 may be included within the bottom cap 20, such that the sealed housing may be inserted therewithin.

Figure 7:
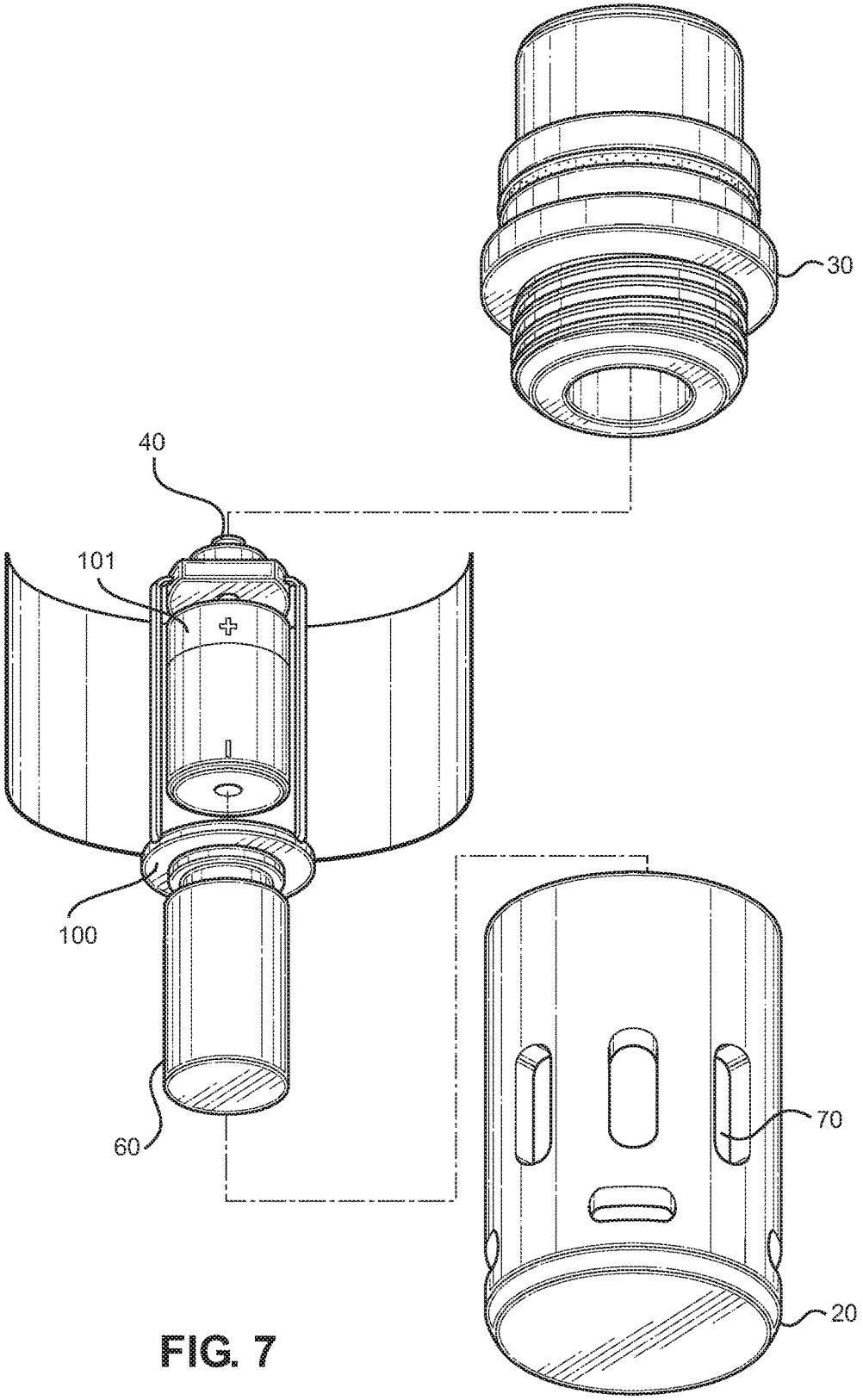
FIG. 7 illustrates a view of the personal protection device with various components exposed, according to another exemplary embodiment of the present general inventive concept.

FIG. 7 illustrates a view of the personal protection device 1 with various components exposed, according to another exemplary embodiment of the present general inventive concept.

Referring to FIG. 7, a battery 101 connects the toggle button 40 and the circuit board 100, which is connected to the sealed housing 60, which houses a coil (not illustrated) and a liquid (not illustrated) to be heated by the coil in response to the toggle button 40 being depressed.

Figure 8:
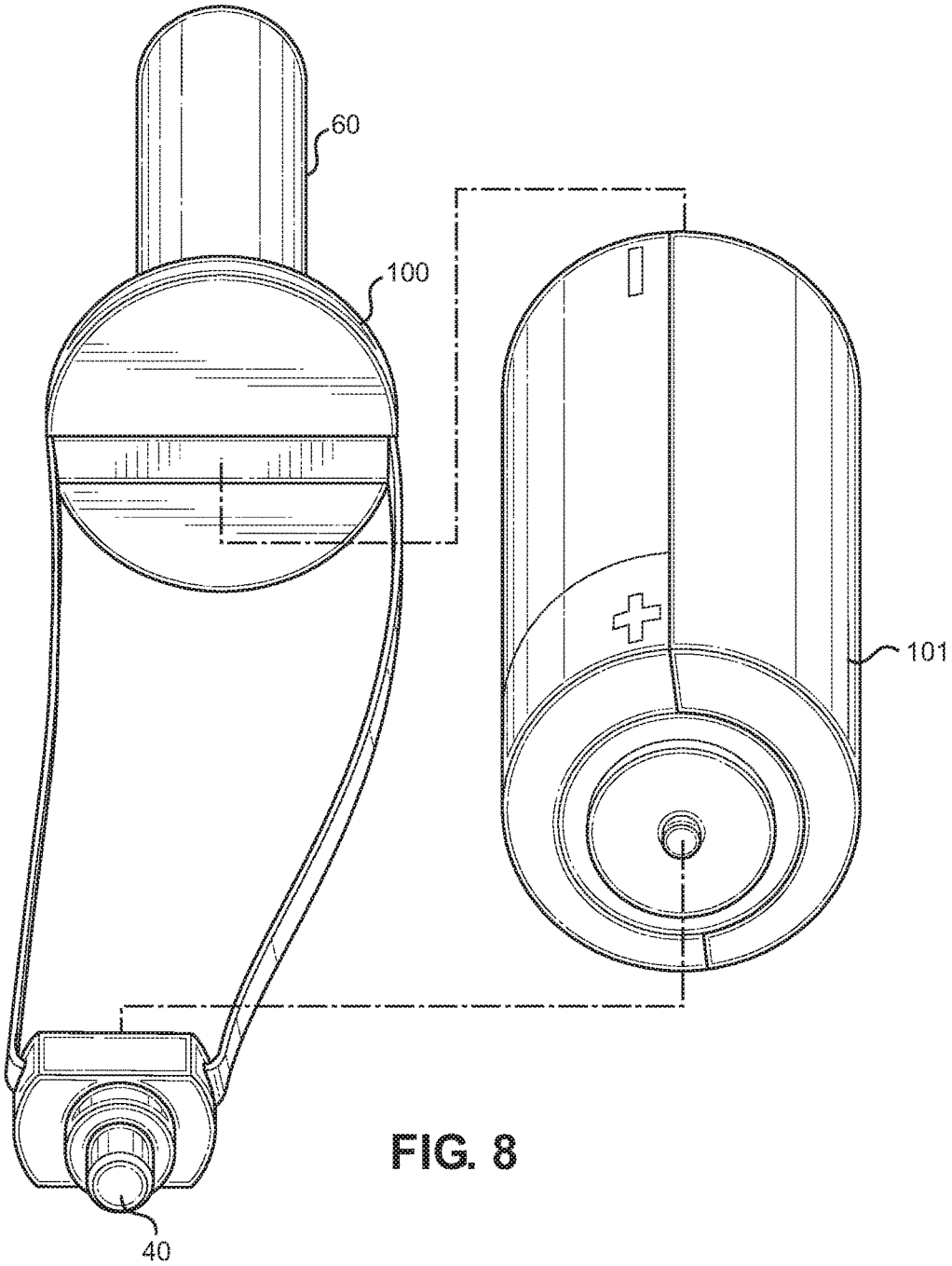
FIG. 8 illustrates a zoomed-in view of inner-most components of the personal protection device, according to another exemplary embodiment of the present general inventive concept.

FIG. 8 illustrates a zoomed-in view of inner-most components of the personal protection device 1, according to another exemplary embodiment of the present general inventive concept.

Referring to FIG. 8, the battery 101 is removed from between the toggle button 40 and the circuit board 100.

Figure 9:
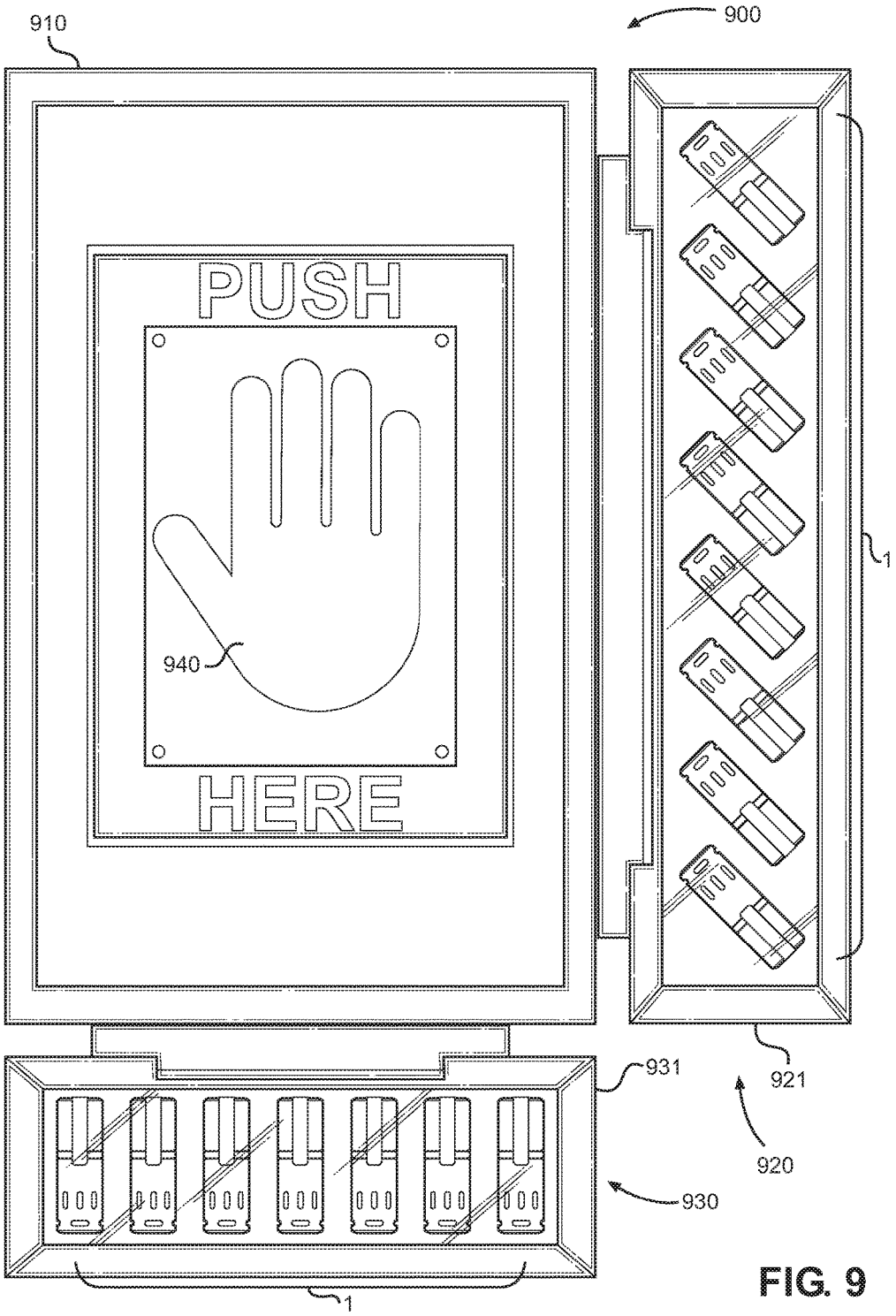
FIG. 9 illustrates a diagram of a wall-mounted access system for at least one personal protection device, according to an exemplary embodiment of the present general inventive concept.

FIG. 9 illustrates a diagram of a wall-mounted access system for at least one personal protection device 1, according to an exemplary embodiment of the present general inventive concept.

Referring to FIG. 9, a wall-mounted access system 900 may include a recognition panel 910, a first distribution panel 920, and a second distribution panel 930.

The recognition panel 910 may include technology to recognize a fingerprint of a user, a hand-print of a user, a voice of a user, a face of a user, or may include a keyboard to allow a user to type in a code. As illustrated in FIG. 9, the recognition panel 910 may include a touch pad 940 connected to circuitry or a computer. As such, the recognition panel 910 allows an authorized user to access the personal protection devices 1 disposed within the first distribution panel 920 or the second distribution panel 930, while preventing an unauthorized user from accessing the personal protection devices 1. This, for example, would prevent children in a school from accessing the personal protection devices 1, while allowing a teacher, for example, to, access the personal protection devices 1 during an emergency.

The first distribution panel 920 may include a cover 921, and the second distribution panel 930 may include a cover 931, to prevent unauthorized users from accessing the personal protection devices 1. When an authorized user is given access via the recognition panel 910, the cover 921 and/or the cover 931 may be opened. When the cover 921 and/or the cover 931 are closed after having been opened, the cover 921 and/or the cover 931 automatically lock until the recognition panel 910 recognizes another authorized user. The cover 921 and the cover 931 may be transparent, semi-transparent, or opaque.

The personal protection devices may be mounted within the first distribution panel 920 and the second distribution panel 930 using hooks, tape, VELCRO, magnets, or any type of mounting mechanism that allows a user to easily remove the personal protection devices 1.

The following table illustrates examples of different values of capacitors and resistors, and corresponding times of delay based on the different values. Note that the different values are not limited to the values illustrated.

TABLE 1

| Capacitor (uF) | Resistor (ohms) | Time (seconds) |
|---|---|---|
| 100 | 47000 | 4.51 |
| 22 | 47000 | 1.69 |
| 1 | 47000 | Instant |
| 47 | 47000 | 2.8 |
| 120 | 47000 | 5.69 |
| 1000 | 47000 | 55.25 |
| 100 | 100000 | 10.34 |
| 100 | 4700 | 0.79 |
| 100 | 1000000 | 97.81 |

The personal protection device 1 is not limited to the above components or values, and may include variations on all components, as well as various arrangements of components. More specifically, the circuit diagrams illustrated in FIGS. 3A and 3B may include a plurality of various arrangements not limited to the arrangement of the components as illustrated, based on a user's preferences or overall size requirements.

Another embodiment of the present general inventive concept may house a smoke composition that may be stored within a cylindrical tube made from aluminum or any other metal known to one of ordinary skill in the art. The cylindrical tube may be open at a first end and closed at an opposite end. The cylindrical tube may have a diameter of approximately 25 mm, wall thickness approximately of 0.5 mm, a height variable depending on the amount of smoke the consumer wants, between 37-42 mm, such that more smoke results in a less concealable cylindrical tube, but is not limited to the aforementioned measurements. The closed end of the cylindrical tube may have small hole. The small hole may correspond to a diameter of an interior void of the smoke composition (e.g., between 7-9 mm). Accordingly, a lower casing for the smoke variant of the present general inventive concept may be an outer cylinder of aluminum packed with a cylinder of smoke composition with a cylindrical void down the long axis which terminates at the hole in the outer casing. The other end of the void is where the filament may be disposed. The filament may be the exact same filament from the sealed version with butane small gauge (44-50 AWG) nichrome wire between two conductive leads with a resistance between 1.2 and 3 ohms. This filament may be dipped in a pyrogen –50/50 mix of potassium chlorate and antimony trisulfide with a small amount of nitrocellulose binder. A quantity of the pyrogen on the filament may be less than the butane version. A small portion of the pyrogen will be applied to the inner wall of the smoke composition near the top/filament. A firing chain may be a battery-switch-filament-pyrogen on filament-pyrogen on smoke-smoke. Furthermore, the present embodiment may not require a circuit board, because a delay may not be needed as operational employment of smoke is usually under duress and a user most likely requires the smoke as quickly as possible. Once the smoke composition is oxidizing (i.e., burning) it may be evolving smoke rapidly. This smoke may fill up the inner void until the heat and pressure overcome a piece of adhesive tape that is covering the outlet hole. The adhesive tape may be necessary to keep the smoke composition from absorbing moisture. To aid in moisture absorption prevention, the inner void may be also coated in a nitrocellulose lacquer, which may burn, but may also provide a moderate amount of moisture protection if the tape is compromised.

The entire assembly of smoke composition may be affixed to the upper casing, battery, switch, and connections. As previously stated, the timing circuit can be present or absent depending on consumer preference. The smoke composition may include 13%—B4C, 60%—KNO3, 25%—KCl, and 2%—Calcium stearate, but is not limited thereto.

The present general inventive concept may be produced and marketed as a personal protection device 1 having various names, variations, and optional components, as follows:

Variation 1—The 100

This variation has a form factor suitable for daily carry (could carry multiple devices easily). The sound emitted from this variation may exceed a 130 dB human pain threshold. This variation may be rugged, inexpensive, easy to use, operable by a user with one hand, deployable away from the user, and one-time usable. Also, this variation may have an anticipated and uniform time delay, a long shelf life, and low maintenance costs.

Variation 2—1000

This variation is a larger version of the 100, which in effect, may produce and emit a larger noise. The 1000 may be primarily designed for military and law enforcement Variation 3—100S This variation may generate smoke and/or haze in addition to loud noise.

Variation 4—200

This variation may use miniature electronic components. The goal of the X200 is to make the device as small as a stack of three or four pennies.

Variation 5—100P

This variation may disperse pepper powder in addition to emitting a loud noise.

Variation 6—100R

This variation may disperse high visibility red/UV marking paint in addition to emitting a loud noise.

Variation 7—100M

This variation may produce multiple loud noises in quick succession from a single device.

Variation 8—100V

This variation may include a time delay that is variable, either at the factory or through a dial adjusted potentiometer.

Variation 9—101

This variation may not contain a push-toggle-on switch. Instead, the switch may be built into the safety release on the top of the device so that the act of removing it from a carrying cradle initiates a timer. This variation will likely have a 1-2 second delay, designed to burst in mid-air instead of on the ground behind the target.

Variation 10—Induction Coil Technology

This variation may employ induction coil technology and circuitry to heat filament/coil sealed housing without direct physical connection to the circuitry or battery. This variation would be designed for quick reloading.

Variation 11—Ammunition

This variation may employ a cam, lever, sear or hammer to strike the primer of a round of blank ammunition.

Variation 12—Blasting Cap

Variation may replace proposed sealed housing (comprising coil/filament) with a conventional blasting cap and no bottom case. This variation would be designed for priming explosive charges.

Carrying Cradle Option

A carrying cradle (not illustrated) may be included with an integrated belt loop to allow a user to wear the personal protection device 1. The carrying cradle may protect a push-toggle-on switch on the personal protection device 1 from accidental activation during storage, transport and deployment, thereby eliminating a need for the top cover 20. The carrying cradle may interface with an overmolded safety button on top of the personal protection device 1 and female receptacles on bottom of the personal protection device 1 to hold the personal protection device 1 securely. Theoretically, it would be impossible to remove the personal protection device 1 from the carrying cradle without first pushing down on the overmolded plastic button on the top of the device. A pressure/force required to push this button down may be of sufficient resistance to prevent child access or inadvertent release.

Charger Option

A charger (not illustrated) for the personal protection device 1 may be a discrete unit including a circuit board and a housing (i.e., body), which may be used when a rechargeable battery is included in the personal safety device 1. The circuit board may contain four LEDs, but is not limited thereto, which may include two red LEDs and two green LEDs, and a 5532 chip (i.e., a dual op-amp). A 9 volt battery can be plugged into the circuit board on one side of the housing. When the personal safety device 1 is inserted within the charger correctly, the first green LED may illuminate. When the personal safety device 1 is inserted within the charger incorrectly (which is extremely difficult because it won't stick to the board) the first red LED may illuminate. A charging capacitor within the charger may be completely overmolded, and the charger body may form a rough "T" shape. The 9 volt battery get affixed to the underside of one crossbar. The personal protection device 1 may be affixed to the underside of the other crossbar. There may be guides that keep both the 9 volt battery and the X100 from falling off the charger easily. The top of the crossbar may display the four LEDs from the circuit board, two on the battery side (red and green) and two on the X100 side (red and green). The second red LED may illuminate when the personal safety device 1 body is affixed to the charger body and the charging capacitor has less voltage than the 9 volt battery. The green LED on the personal safety device 1 side of the charging body crossbar may illuminate when the charging capacitor reaches equilibrium with the supply voltage coming from the 9V battery.

A charging body of the charger may contain a female microUSB port, as these have become ubiquitous in the market due to cell phone charging requirements. The circuit on this charger would have to be modified to increase the 6 volts from USB to the 9 volts that the standard X100 operates on. Alternatively, a 5 volt version of the personal safety device 1 may be included.

Public Box Option

A public box (i.e., box) may include a rectangular box, a multifunction door, a personal protection device 1 chassis, and optional autodialer connected to circuitry within the box to allow for autodialing and/or VOIP operation and functionality for access to the box. For example, the autodialer functionality may include a circuit board that dials factory loaded or user loaded DTMF code (default code, 911). Alternatively, the autodialer may utilize a Wifi signal incorporated to access a third party security system.

The box may be made of non-conducting plastic, but is not limited thereto, and may be designed to be mounted on a wall. The box may contain inside of it one or multiple chassis designed to hold multiple personal protection devices 1. This chassis may protect the push toggle-on switch of each personal protection device 1 while presenting them to the user in an easy to acquire fashion (likely a 45-degree cant). The persona protection devices 1 loaded into the chassis may likely not utilize the top-molded safety button which allows positive connection with the carrying cradle. The box chassis design may allow for more rapid employment of multiple users, including children. To reduce illicit or prank access to the devices the box will have a door which secures over the chassis. The mechanism for unlocking the door to gain access to the personal protection devices 1 may be a palm-sized push panel built into the door. The resistance on this panel may be great enough to prevent accidental activation but small enough for children to effectively activate the release mechanism. The palm-sized panel may have a mechanism on it to secure to its surface a forensic palm print lifting acetate. This lifting acetate may record the palm print of anyone who activates the door release by pushing on the panel. This may aid investigators in identifying witnesses and/or pranksters. The goal is to make this box as ubiquitous as fire extinguishers and AEDs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A personal protection device, comprising:

a central casing including a battery;

a toggle button connected to the battery; and a sealed housing including a coil switchably connected to the battery and a liquid, such that pressing the toggle button connects the battery to the coil to heat the liquid to convert the liquid to a gas until an audible shock wave is generated.

2. The personal protection device of claim 1, further comprising:

a timer integrated circuit connected to the battery to provide a delay of a predetermined length of time between a first moment when the toggle button is depressed and a second moment when the audible shock wave is generated.

3. The personal protection device of claim 1, further comprising:

a bottom cap to house the sealed housing and at least a portion of the central casing; and a removable top cap to house the toggle button and at least another portion of the central casing.

4. The personal protection device of claim 3, wherein the bottom cap comprises at least one aperture to allow gas to escape therefrom.

5. The personal protection device of claim 3, wherein the bottom cap comprises a casing space to house the sealed housing therein.

6. The personal protection device of claim 1, wherein the central casing further comprises:

a female Universal Serial Bus port to allow the battery to be charged without removing the battery from the central casing.

7. A personal protection device, comprising:

a central casing including a battery;

a toggle button connected to the battery;

a removable top cap to enclose the toggle button, the battery, and at least a portion of the central casing therewithin:

a sealed housing including a combustible or vaporable composition therewithin, such that the combustible or vaporable composition deflagrates after the toggle button is pressed; and a bottom cap to enclose the sealed housing and at least a portion of the central casing therewithin.

8. The personal protection device of claim 7, wherein the sealed housing further comprises a coil switchably connected to the battery and the combustible or vaporable composition, such that the coil produces heat in response to the pressing of the toggle button.

9. The personal protection device of claim 8, wherein pressing the toggle button electrically connects the battery to the coil to heat the liquid to convert the liquid to a gas until an audible shock wave is generated.

10. The personal protection device of claim 9, further comprising a timing circuit to provide a delay between the pressing of the toggle button and the heating of the coil.

* * * * *